United States Patent [19]

Keller

[11] 4,373,340

[45] Feb. 15, 1983

[54] PEAK LOAD DEVICE OF A MULTISTAGE TURBINE

[76] Inventor: Herbert Keller, Krähenbüschken 4, 4330 Mülheim, Fed. Rep. of Germany

[21] Appl. No.: 171,343

[22] Filed: Jul. 23, 1980

[30] Foreign Application Priority Data

Jul. 25, 1979 [DE] Fed. Rep. of Germany ..... 2930184

[51] Int. Cl.[3] ..... F01K 13/00

[52] U.S. Cl. ..... 60/677; 60/652; 60/679

[58] Field of Search ..... 60/652, 677, 679, 653, 60/662, 663, 670

[56] References Cited

U.S. PATENT DOCUMENTS

| | | | |
|---|---|---|---|
| 1,915,983 | 6/1933 | Doran | 60/662 X |
| 2,066,151 | 12/1936 | Johansson | 60/679 |
| 2,268,356 | 12/1941 | Turner | 60/677 X |

*Primary Examiner*—Allen M. Ostrager
*Assistant Examiner*—Stephen F. Husar
*Attorney, Agent, or Firm*—Herbert L. Lerner

[57] ABSTRACT

Peak load device of a multistage turbine, having a high pressure turbine section with an inlet pipe supplying working medium and an exhaust steam outlet, a subsequent turbine section having an inlet pipe connected to the exhaust steam outlet of the high pressure turbine section for receiving the exhaust steam thereof, a bypass line connected from the high pressure turbine section inlet pipe to the subsequent turbine section inlet pipe through which part of the working medium bypasses the high pressure turbine section as a bypass flow, including a jet compressor inlet disposed at the connection of the bypass line to the subsequent turbine section inlet pipe for receiving the bypass flow as a motive medium while increasing the pressure of the flow through the subsequent turbine section inlet pipe.

11 Claims, 4 Drawing Figures

PEAK LOAD DEVICE OF A MULTISTAGE TURBINE

The invention relates to a peak load device of a multistage turbine, especially a steam turbine with a high pressure section, the exhaust steam of which is fed to a subsequent or intermediate pressure section, and with a bypass line, through which part of the working medium can be conducted into a pipe line leading to the inlet end of the subsequent section bypassing the high pressure section.

In peak load devices of this type, the increase of the instantaneous power reserve and the peak load capacity of the turbine with minimum heat consumption represent a particular problem. If possible, the efficiency in the normal load range should not be adversely affected. It has been attempted to solve the above-mentioned problem in various ways. Thus, high pressure bypass stations have been provided in which a bypass flow of the live steam is detoured around the high pressure turbine part, or the turbo-set is run in the nominal load region with the live steam throttled and the live steam control valves are then opened fully, if an instantaneous power demand exists. The last-mentioned possibility has the disadvantage that at nominal load, the throttling losses are too high; the first-mentioned possibility has the disadvantage that the heat consumption in the peak load region is large.

It is accordingly an object of the invention to provide peak load devices of a multistage turbine which overcomes the hereinafore-mentioned disadvantages of the heretofore-known devices of this general type, and to allow for an increase of the instantaneous power reserve and peak load capacity without adversely affecting the efficiency of the turboset in the normal load range, but at the same time, giving the turboset a smaller heat consumption increase for peak load than is the case with the above-mentioned bypass flow of the high pressure part. In addition, the peak load device according to the invention should allow quick reaction of the turboset to the increased load demand.

With the foregoing and other objects in view there is provided, in accordance with the invention, a peak load device of a multistage turbine, having a high pressure section with an inlet pipe supplying working medium and an exhaust steam outlet, a subsequent section having an inlet pipe connected to the exhaust steam outlet of the high pressure section for receiving the exhaust steam thereof, a bypass connected from the high pressure section inlet pipe to the subsequent section inlet pipe through which part of the working medium bypasses the high pressure section as a bypass flow, comprising jet compressor inlet means disposed at the connection of the bypass line to the subsequent section inlet pipe for receiving the bypass flow as a motive medium while increasing the pressure of the exhaust steam of the high pressure section flowing through the subsequent section inlet pipe. The advantages obtainable with the invention are in particular that in the load range 100% ($\overline{P} \leqq 1.0$) no adverse effect on the heat consumption occurs; that an instantaneous power reserve is provided by introducing the high-pressure steam directly ahead of the subsequent section and changes of valves and turbine stages of turbosets already in operation are not necessary; the change extends merely to the steam lines of the high pressure turbine and to the subsequent pressure turbine which follows a reheater. A further important advantage is that in the steam jet compressor a recovery of about 15% of the kinetic energy of the motive steam or the high-pressure steam flow can be obtained which is available as potential energy ahead of the subsequent section so that a pressure increase ahead of the subsequent section in the order of magnitude of 2% is obtained.

In accordance with another feature of the invention, the subsequent section inlet pipe includes a reinforced pipe wall defining a given inside pipe diameter, and the reinforced pipe wall has at least one nozzle canal of the jet compressor formed therein outside the given inside pipe diameter.

In accordance with a further feature of the invention, the at least one nozzle canal or nozzle is formed at an angle of between 10° and 40° to the axis of the subsequent section inlet pipe.

In accordance with an added feature of the invention, there is provided a settling section or the single driving nozzle having a given length formed in the subsequent section inlet pipe in the vicinity of the at least one nozzle canal, the given length being relatively greater when one nozzle canal is provided and relatively less when more than one nozzle canal is provided.

In accordance with an additional feature of the invention, there is provided a construction in the form of a Venturi nozzle disposed in the subsequent section inlet pipe in the vicinity of the jet compressor.

In accordance with still another feature of the invention, there is provided a straight section of pipe having an inside diameter of between five and twenty times the given diameter, disposed downstream of the at least one nozzle canal.

In accordance with still a further feature of the invention, there is provided at least one other individually connectible nozzle canal or driving nozzle.

In accordance with still an added feature of the invention, the at least one nozzle canal or driving nozzle is in the form of at least two nozzle canals uniformly distributed about the periphery of the subsequent section inlet pipe, and including motive steam connecting stubs connected from the nozzle canals to the bypass line.

In accordance with yet another feature of the invention, the at least two nozzle canals are in the form of two nozzle canals or driving nozzles disposed diametrically opposite each other.

In accordance with yet a further feature of the invention, the at least one nozzle canal or driving nozzle is in the form of a Laval nozzle.

In accordance with a concomitant feature of the invention, there is provided a reheater connected between the high pressure section exhaust steam outlet and the secondary turbine part inlet pipe, a regulating valve disposed in the bypass line, control valves disposed in the high pressure section inlet pipe downstream of the bypass line, and other control valves disposed in the subsequent section inlet pipe downstream of the jet compressor, the high pressure section forming a high pressure part, the subsequent section forming at least one medium or lower pressure part and the reheater forming another part of a throttle-regulated turbo set in which the peak load device is used.

Other features which are considered as characteristic for the invention are set forth in the appended claims.

Although the invention is illustrated and described herein as embodied in a peak load device of a multistage turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
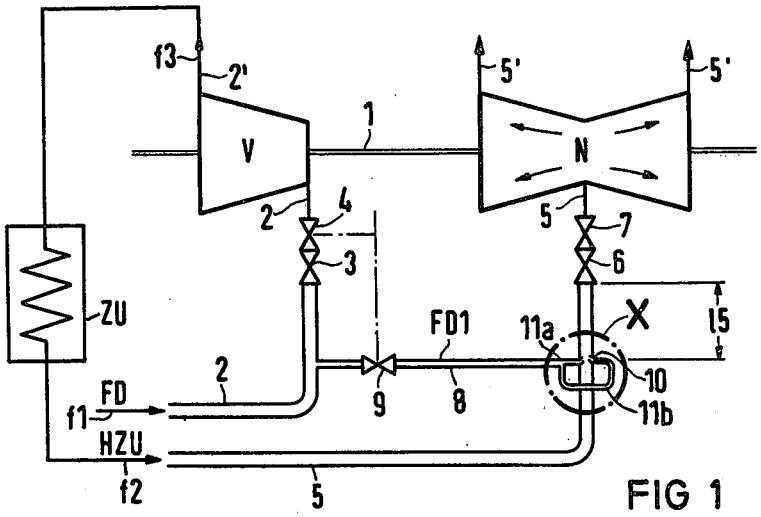
FIG. 1 is a schematic and diagrammatic view of a high-pressure and a subsequent or intermediate pressure section of a turbine with its live-steam lines and its valves as well as with a bypass line feeding the steam jet compressor for a turboset with a reheater, omitting the parts which are unnecessary for an understanding of the invention.

Referring now to the figures of the invention, and first particularly to FIG. 1 thereof, there is seen a partial view of a throttle-regulated turboset with a reheater which includes a high-pressure turbine V and, for instance, a double-flow subsequent or intermediate pressure turbine N which follows the high pressure subturbine V. Illustrated in the figures is a single-shaft turboset, i.e. the shaft 1 is common to the rotors of the turbines V and N, which are not shown in detail. The high pressure turbine or section V will be designated for short hereinbelow as the H-part and the subsequent section or intermediate pressure turbine N will be designated for short as the MN-part. The live steam FD (see arrow f1 in FIG. 1) is fed to the H-part through the live steam line 2 and the control valves 3,4 disposed in the train of the line 2. The valve 3 is a fast-acting shut-off valve and valve 4 is the regulating valve. After flowing through the individual stages of the H-part, the steam is fed through the exhaust steam pipe of the H-part, indicated at reference numeral 2' (see arrow f3), to a reheater ZU.

From the reheater, the reheated steam HZU (see arrow f2) flows through the steam supply line 5 of the MN-part N and through the control valves 6 and 7 disposed in the train of the line 5 into the MN-part N. After expansion in the MN stages, the steam leaves the MN-part through the two exhaust steam lines indicated at reference numeral 5', from which the exhaust steam can be conducted to a steam condensor, not shown. Valve 6 is again a fast-acting shut-off valve and valve 7 is a regulating valve of the MN part. Instead of the double-flow MN part, a single-flow MN part could also be used. The bypass line 8 with a regulating valve 9 is connected on the inlet side thereof to the live steam pipe 2 of the H-part ahead of its fast-acting shut-off valve 3, and leads on the outlet side thereof into the HZU steam line 5 of the MN-part N ahead of the fast-acting shut-off valve 6 of the latter. The opening point 10 is designed as the steam jet compressor for the HZU steam; the detoured high-pressure live steam can be fed to this steam jet compressor as the motive steam through the motive steam lines 11*a*, 11*b*.

Figure 2:
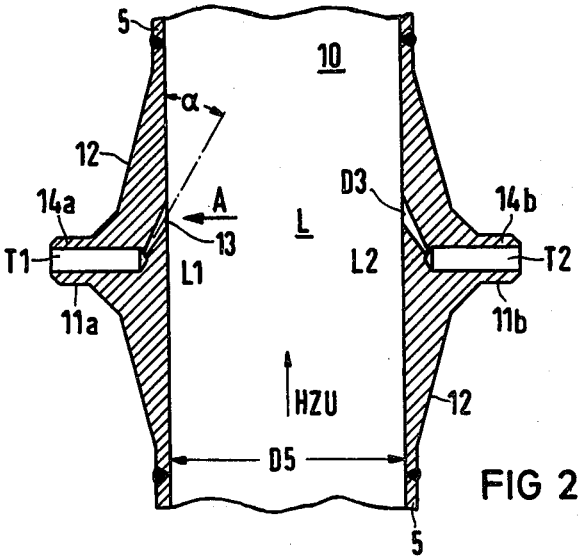
FIG. 2 is an enlarged detailed cross-sectional view of the area within the dot-dash circle X in FIG. 1, showing the construction of the steam jet compressor.
Figure 3:
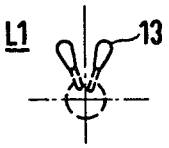
FIG. 3 is an enlarged fragmentary elevational view of FIG. 2, as seen in direction of the arrow A.

Shown in greater detail in FIGS. 2 and 3, the steam jet compressor 10 includes several (in the present case four) nozzles or Laval nozzles L with nozzle canals 13 which are disposed in the vicinity of pipe reinforcements 12 of the HZU line 5 and lead at an incline inward into the line 5 at an angle $\alpha$ to the HZU flow direction. In principle it is possible to locate the nozzles L with their associated motive steam connecting stubs 14*a*, 14*b* distributed over the circumference of the pipe. Through the uniform distribution of the nozzles and the motive steam connecting stubs, symmetry of the steam flow is obtained; the size of the cross section of the nozzles serves for adaptation to the mass flow. In the present case, in which an overload capacity of about 7% is to be achieved by the detoured live steam, it is sufficient to provide two nozzle pairs L1 and L2 which are diametrically oppositely disposed and each have a common motive steam connecting stub 14*a*, 14*b*. Such a pair of nozzles L1 is shown in the top view according to FIG. 3. It is seen from FIG. 3, and a cross section according to FIG. 2, that in the pipe reinforcement 11*a*, 11*b*, radially oriented motive-steam bore holes T1, T2 are first made, and that the nozzle canals 13 lead with an inward slant into the interior of the pipe 5 at an angle $\alpha$. An advantageous range for this angle $\alpha$ is between 10° and 40°; in the case shown, very good results would be obtained with an inlet angle of about 30°. Further detailed data for the construction of the flow cross sections of the embodiment example are as follows:

Rated power of the turboset, 600 MW; four live steam pipes 2, each with an inside diameter of 250 mm; four ZU lines 5 leading into the MN-part, each with 500 mm inside diameter; four bypass lines 8 with 60 mm inside diameter each; inside diameter of the nozzles 13 at the narrowest cross section, 18 mm; inside diameter of the bore holes T1, T2, 50 mm.

The turboset shown is constructed for an overload $\Delta P$ (steady-state) of 7.1%; starting with the time $t=0$ for the load jump and corresponding actuation of the control valves 4, 9, the power increase $\Delta P$ is already 1.5% after one second and 6% after 10 seconds, compared to the unlimited storage capacity of the boiler. The change of the specific heat consumption $\Delta W_T$ for nominal load $\overline{P}=1$ can be set as 0%; $\Delta W_T$ for $\overline{P}=1.071$ is 1.2%. The total live steam stream is about 13% larger.

In case of a load demand, the control valve 9 is therefore opened more or less, so that the bypass flow FD1 (FIG. 1) can be fed as the motive medium to the steam jet compressor 10, while the pressure of the HZU steam flowing through the pipe 5 to the secondary turbine part N is increased. As shown in FIG. 2, the nozzle canals 13 of the steam jet compressor 10 are disposed in the reinforced pipe wall 12 of the inflow line 5 in such a manner that they are outside the inside pipe diameter D5. Following the nozzle L of the jet compressor 10, a straight pipe section 15 is provided as shown in FIG. 1, which is about 5 to 20 times as large as the pipe diameter D5 of the pipeline 5. This pipe section serves for quieting and for pulse equalization of the steam flow before it enters the MN-part N. In a construction of the nozzles L distributed uniformly over the pipe circumference, this settling section can be smaller than in the case of an asymmetrical distribution of the nozzles.

Figure 4:
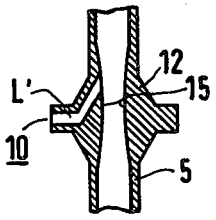
FIG. 4 is a diagrammatic cross-sectional view of a variant embodiment of the steam jet air injector with only one driving nozzle.

The latter asymmetrical construction is shown in the embodiment example according to FIG. 4 which can replace the FIG. 2 embodiment at section 15 in FIG. 1. There, the motive medium is introduced in a one-sided manner. In turn, a correspondingly extended settling pipe section is provided behind or downstream of the nozzle. The settling section here will therefore approach twenty times the pipe diameter. In addition, an embodiment is shown in FIG. 4 where the pipe line 5 has a constriction 15 in the form of a Venturi nozzle in the vicinity of the steam jet compressor 10. The nozzle L' then opens into the interior of the pipe approximately in the area of this constriction 15. The constriction according to the illustrated example leads to an increase of the jet compressor efficiency and also somewhat increases the losses in the load range up to nominal load. The limitation to a one-sided motive medium introduction is construction-wise simpler than the symmetrical one and still provides good steam jet compressor efficiency if a sufficiently long settling section follows.

In addition to the advantages already explained hereinafore, the following advantages of the overload device according to the invention can further be referred to:

1. Additional, short-time pressure increase ahead of the MN-part N through temporary backing-up of the ZU flow (approximately 0.5% pressure increase);
2. Reduction of the relative pressure loss in the reheater in the event of an overload by 25%;
3. Substantially smaller control valve in the bypass line 8 as compared to a peak load H-stage valve.

Further characteristic data of the peak load device are as follows:

The feedwater end temperature is regulated according to the load. The ZU-FD steam flow ratio is 13% smaller in the case of a peak load. Steam temperature ahead of the MN-part N is 6° K. lower (mixture temperature). The required straight pipe section behind the steam jet compressor 10 is approximately eight times the inside diameter of the pipe (FIG. 1).

The following is a tabular comparison of the subject of the invention with other known peak load devices (unlimited storage capacity of the boiler is assumed here for the 10-second values. Actual values depend on the type of the boiler and the furnace and are as a rule 0.4 to 0.7 times these values):

| | $\Delta P$ after 1 s | $\Delta P$ after 10 s* | $\Delta P$ steady-state | $\Delta W_T$ for $\overline{P} = 1$ | $\Delta W_T$ for $\overline{P} = 1.071$ |
|---|---|---|---|---|---|
| Invention | 1.5% | 6.0% | 7.1% | 0% | 1.5% |
| H-bypass station | 0% | 4% | 7.1% | 0% | 1.8% |
| Throttling | 2.5% | 5% | 7.1% | +0.7% | +0.4% |
| H-stage valve | 2.5% | 5% | 7.1% | +0.2% | +0.5% |
| H-regulating stage | 2.5% | 5% | 7.1% | +0.3% | +0.7% |
| H-preheater bypass | 0% | 2% | 7.1% | 0% | 2.2% |
| Condensate stop | 0% | 1% | 5% | 0% | — |
| M-stage valve | 4% | 6.5% | 7.1% | 0.2% | 2.5% |

*referred to unlimited storage capacity of the boiler.

The list of symbols for the chart is as follows:

$\Delta P$=load change $\overline{P}$=steady-state peak load which was assumed to be 7.1% maximum $\Delta W_T$=change of the heat consumption.

A comparison with those peak load devices in which $\Delta W_T$ for $\overline{P}=1$ is 0% shows that with the subject of the application, the power increase is a maximum after 10 seconds and that among the four peak load devices considered, $\Delta W_T$ for $\overline{P}=1.071$ is also a minimum.

There are claimed:

1. Peak load device of a multistage turbine, having a high pressure turbine section with an inlet pipe supplying working medium and an exhaust steam outlet, a subsequent turbine section having an inlet pipe connected to the exhaust steam outlet of the high pressure turbine section for receiving the exhaust steam thereof, a bypass line connected from the high pressure turbine section inlet pipe to the subsequent turbine section inlet pipe through which part of the working medium bypasses the high pressure turbine section as a bypass flow, comprising jet compressor inlet means disposed at the connection of the bypass line to the subsequent turbine section inlet pipe for receiving the bypass flow as a motive medium while increasing the pressure of the flow through the subsequent turbine section inlet pipe.

2. Peak load device according to claim 1, wherein said subsequent turbine section inlet pipe includes a reinforced pipe wall defining a given inside pipe diameter, and said reinforced pipe wall has at least one nozzle canal of said jet compressor formed therein outside said given inside pipe diameter.

3. Peak load device according to claim 2, wherein at least one nozzle canal is formed at an angle of between 10° and 40° to the axis of said subsequent turbine section inlet pipe.

4. Peak load device according to claim 2, including a settling section having a given length formed in said subsequent turbine section inlet pipe in the vicinity of said at least one nozzle canal, said given length being relatively greater when one nozzle canal is provided and relatively less when more than one nozzle canal is provided.

5. Peak load device according to claim 1, including a constriction in the form of a Venturi nozzle disposed in said subsequent turbine section inlet pipe in the vicinity of said jet compressor.

6. Peak load device according to claim 2, including a straight section of pipe having an inside diameter of between five and twenty times said given diameter, disposed downstream of said at least one nozzle canal.

7. Peak load device according to claim 2, including at least one other individually connectible nozzle canal.

8. Peak load device according to claim 2, wherein said at least one nozzle canal is in the form of at least two nozzle canals uniformly distributed about the periphery of said subsequent turbine section inlet pipe, and including motive steam connecting stubs connected from said nozzle canals to said bypass line.

9. Peak load device according to claim 8, wherein said at least two nozzle canals are in the form of two nozzle canals disposed diametrically opposite each other.

10. Peak load device according to claim 2, wherein said at least one nozzle canal is in the form of a Laval nozzle.

11. Peak load device according to claim 1, including a reheater connected between said high pressure turbine section exhaust steam outlet and said subsequent turbine section inlet pipe, a regulating valve disposed in said bypass line, control valves disposed in said high pressure turbine section inlet pipe downstream of said bypass line, and other control valves disposed in said subsequent turbine section inlet pipe downstream of said jet compressor, said high pressure turbine section forming a high pressure part, said subsequent turbine section forming at least one lower pressure part and said reheater forming another part of a throttle-regulated turbo set.

* * * * *